US006212841B1

(12) United States Patent
Plume

(10) Patent No.: US 6,212,841 B1
(45) Date of Patent: Apr. 10, 2001

(54) BRICK TIE, IN MOULDED PLASTIC

(75) Inventor: John Robert Plume, Mount Forest (CA)

(73) Assignee: J R Plume Construction Ltd., Mount Forest (CA)

( * ) Notice: Subject to any disclaimer, the term of this patent is extended or adjusted under 35 U.S.C. 154(b) by 0 days.

(21) Appl. No.: 09/283,894

(22) Filed: Apr. 1, 1999

(51) Int. Cl.[7] ..... E04B 2/30

(52) U.S. Cl. ..... 52/513; 52/565; 52/698; 52/379

(58) Field of Search ..... 52/712–714, 379, 52/383, 508, 562, 565, 568, 378, 561, 698, 513, 506.01, 434

(56) References Cited

U.S. PATENT DOCUMENTS 4,875,319 * 10/1989 Hohmann ..... 52/383
5,197,255 * 3/1993 Fricker ..... 52/703
5,435,111 * 7/1995 Cox ..... 52/713
5,456,052 * 10/1995 Anderson ..... 52/713
5,634,310 * 6/1997 Hohmann ..... 52/513
5,657,953 * 8/1997 Smith ..... 248/217.1
5,669,111 * 9/1997 Rohaly ..... 24/16
5,673,530 * 10/1997 Bailey ..... 52/606
5,809,728 * 9/1998 Tremelling ..... 52/426

* cited by examiner

*Primary Examiner*—Beth A. Stephan
(74) *Attorney, Agent, or Firm*—Anthony Asuith & Co.

(57) ABSTRACT

For holding brick cladding to a stud frame structure, the brick-tie is a one-piece moulding in plastic. The moulding has a vertical arm, which is secured to the stud by a nail, and a horizontal arm, which is mortar'd between courses of bricks. The nail is located near the junction between the arms, and the junction is chunky enough to be inflexible. The bridge, which spans the space between the bricks and the stud, is also thick enough to be inflexible.

13 Claims, 5 Drawing Sheets

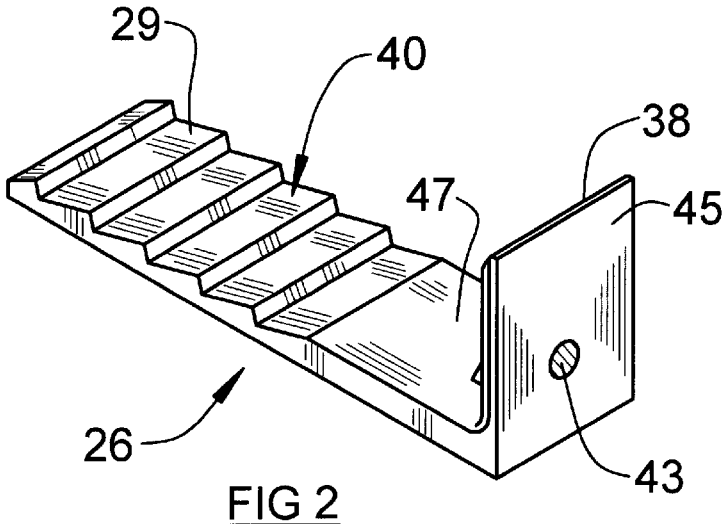
FIG 2
FIG 3
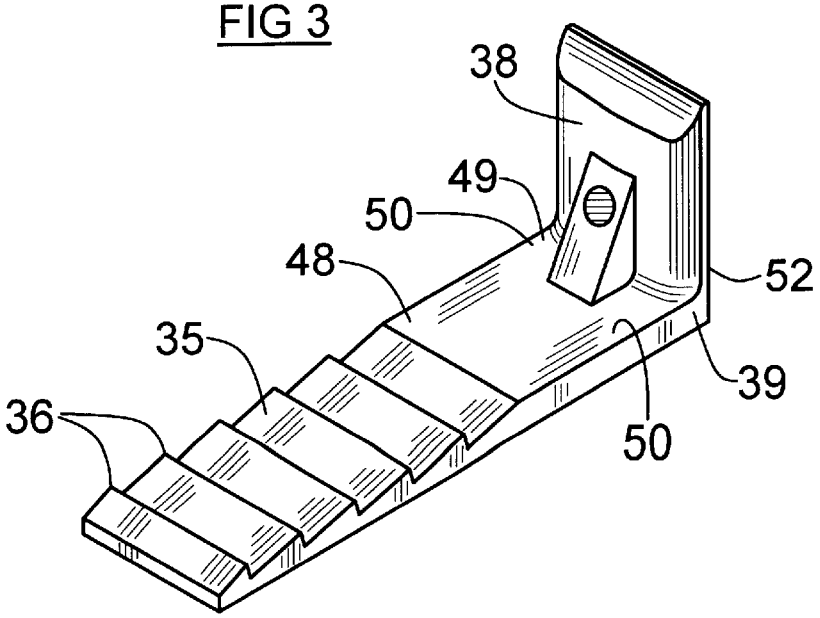

BRICK TIE, IN MOULDED PLASTIC

This invention relates to brick-ties. Brick-ties are used for holding a brick wall, including brick cladding, in the correct spaced relationship with a fixed structure such as a stud wall.

BACKGROUND TO THE INVENTION

Conventional brick-ties are made of metal, and usually from thin galvanised sheet steel. The steel is usually so thin that the brick-tie is easily able to be bent, or otherwise manipulated, with the fingers. The metal brick-ties provide some resistance to the bricks actually pulling away from the fixed structure of the wall, but they are not very effective.

The invention is aimed at providing an improved brick-tie, which overcomes the disadvantages of the conventional brick-tie, and yet which is inexpensive and simple as to its manufacture and use.

THE PRIOR ART

Previous designs of brick-ties are shown in patent publications U.S. Pat. No. 5,634,310 (Hohmann, June 1997) and U.S. Pat. No. 5,456,052 (Anderson, October, 1995).

GENERAL FEATURES OF THE INVENTION

The invention lies in a brick-tie, for tying courses of bricks in a brick wall to a fixed structure, and the brick-tie of the invention is a one-piece moulding, in plastic.

The brick-tie includes a horizontal arm, which includes an in-mortar portion and a bridge portion. The in-mortar portion is so structured as to be suitable for placement, in mortar, between courses of bricks in a brick wall, and the in-mortar portion is provided with moulded-in surface configuration, for increasing the securement grip thereof into the mortar. One end of the bridge-portion is contiguous with the in-mortar portion.

The brick-tie includes a means for securing the other end of the bridge-portion to the fixed structure, and the bridge-portion of the brick-tie is dimensioned to be so inflexible that the bridge-portion cannot, in substance, be bent by finger-manipulation.

The flexibility/inflexibility of the bridge portion is an important feature of the invention. When the bridge-portion is inflexible to the degree specified, the bridge-portion can be relied upon to hold the bricks in the correct spaced relationship with the fixed structure. The thin-sheet-metal brick-tie had so little rigidity that the spacing between the bricks and the fixed structure was really not controlled by the brick-ties, except in the grossest sense. There is a requirement for the brick-tie to have some degree of give in the vertical sense, for example because the bricks might settle relative to the fixed structure. But plastic, especially HDPE for example, inherently has enough give in it that this requirement is met automatically.

One benefit of the invention is that a plastic brick-tie cannot go rusty. Galvanised steel cannot be relied upon not to corrode, especially over a period of perhaps many decades.

When the brick-tie was of thin sheet steel, all aspects of the design of the brick-tie were compromised by that fact. When the brick-tie is moulded in plastic, the designer is free to design the difference areas of the brick-tie according to the different functions each has to perform, and each aspect of performance need not be compromised by the others.

In a preferred form of the invention, the brick-tie includes a vertical arm, and an angled junction between the vertical arm and the horizontal arm, and the means for securing the other end of the bridge-portion to the fixed structure comprises a nail-hole, through the vertical arm. Preferably, the nail-hole in the vertical arm is close to the angled junction. Preferably, the portion of the vertical arm that lies between the nail-hole and the angled junction is thick and chunky, and preferably the bridge-portion of the horizontal arm is thick and chunky. Preferably, the nail-hole is smaller than the accompanying nail, and the nail is held gripped by the nail-hole, during transport and sale of the brick-tie.

When the fixed structure is a stud wall, the nail-head holds a region of the brick-tie hard against the stud-wall. The stiffer (i.e the thicker and more chunky) the region around the nail-hole, the larger the area that can be said to be held hard against the stud-wall. In the designs depicted herein, the angled junction being thick, it is not just the portion around the nail that is held by the nail, as was the case with the conventional metal brick-tie. In the depicted designs, the whole angled-junction region is held hard against the wall. An important benefit of the invention is that the designer can make the bridge portion of the brick-tie as if it were unitary with the stud—at least in the horizontal direction towards and away from the stud wall. Thus the brick-tie has excellent stiffness horizontally, but permits some flexibility in the up/down sense.

DETAILED DESCRIPTION OF PREFERRED EMBODIMENTS

By way of further explanation of the invention, exemplary embodiments of the invention will now be described with reference to the accompanying drawings, in which:

FIG. 2 is a pictorial view of the brick-tie of FIG 1;

FIG. 3 is another pictorial view of the brick-tie of FIG. 1;

The apparatuses shown in the accompanying drawings and described below are examples which embody the invention. It should be noted that the scope of the invention is defined by the accompanying claims, and not necessarily by specific features of exemplary embodiments.

Figure 1:
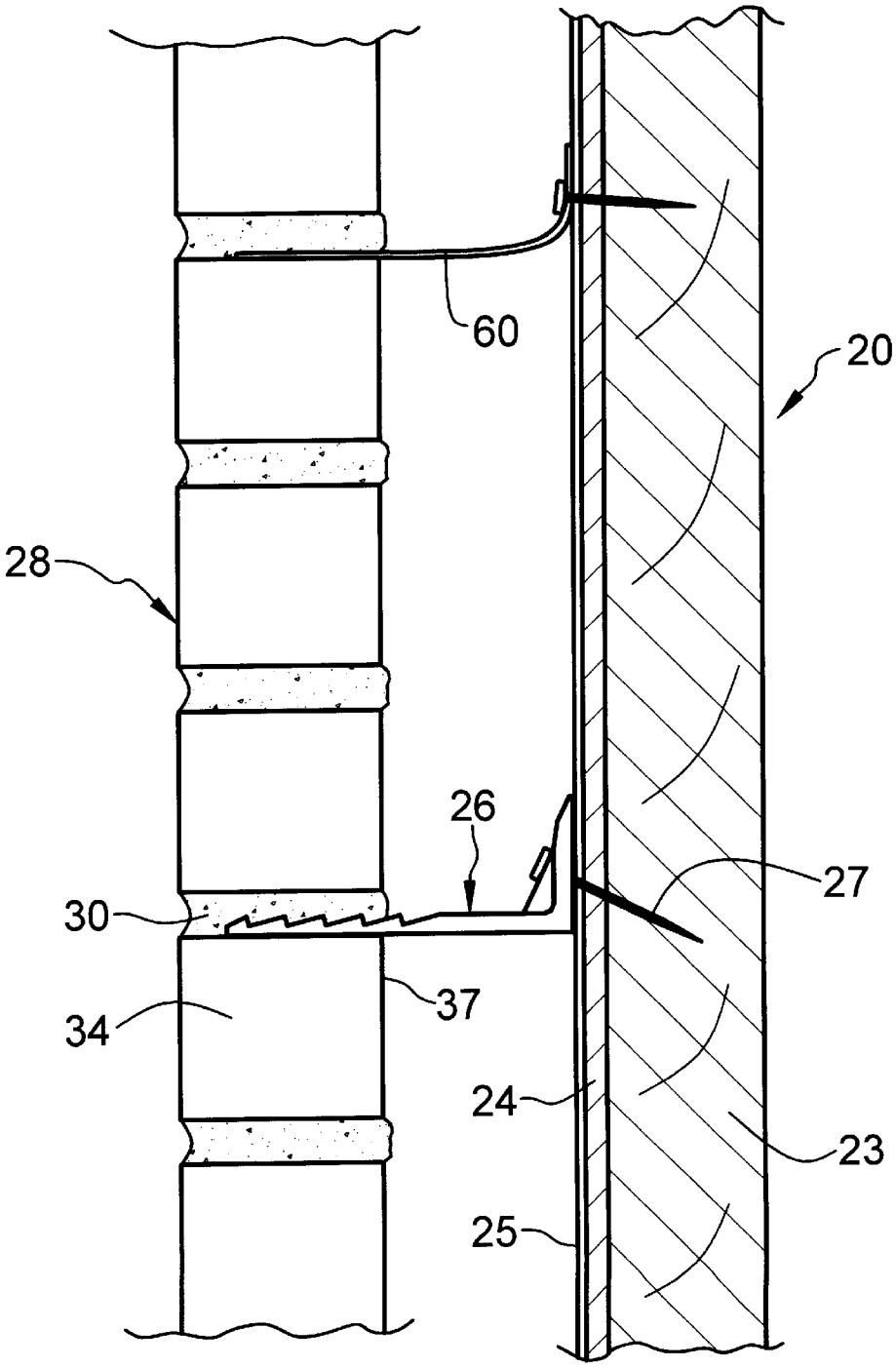
FIG. 1 is a cross-section of a brick-clad wall, which includes brick-ties provided in accordance with the invention.
Figure 4:
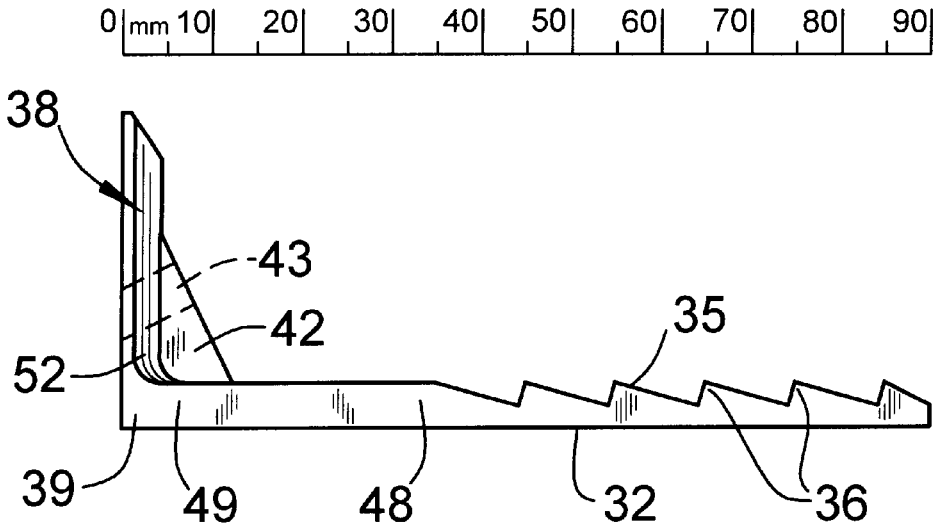
FIG. 4 is a side view of the brick-tie of FIG. 1.
Figure 5:
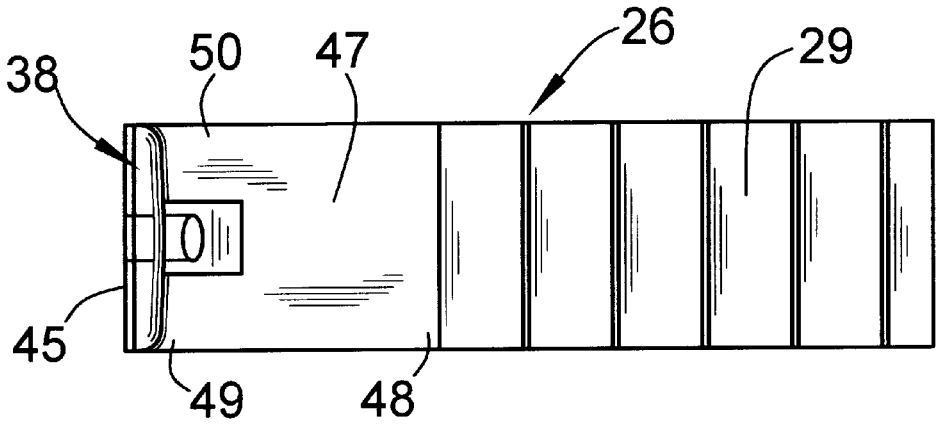
FIG. 5 is a plan view of the brick-tie of FIG. 1.

The wall 20 shown in FIG. 1 is built up from the usual vertical studs 23 of wood. A plywood sheet 24 is nailed outside the studs, and a sheet of plastic or waterproof paper 25 is secured outside the plywood.

The brick-ties 26 are nailed to the studs 23, the nail 27 passing through the paper 25 and through the plywood 24 into the stud.

The brick-tie itself is further illustrated in FIGS. 2,3,4,5.

To install the brick-tie 26, the bricklayer builds up the courses of bricks 28 as required; he places a brick-tie on top of one of the bricks in the last-laid course, while the bricks are still dry, i.e before the application of mortar on top of that course of bricks. He lines the brick-tie up with an appropriate one of the wooden studs 23 and, with the brick-tie resting on top of the brick, drives in the nail 27. Typically, the brick-ties are applied to every stud (the studs are spaced 16 inches apart, typically), and every five or six courses.

With the studs nailed in place, he proceeds to apply mortar 30 over and around the brick-ties, on top of the course 28 of bricks, and proceeds to build up the further courses of bricks.

The under-surface 32 of the brick-tie 26 simply rests on the brick 34 underneath. That is to say, there is no mortar between the top of the brick 34 and the under-surface of the brick-tie. The over-surface 35 of the brick-tie 26 is embedded in the mortar 30, and that surface is provided with ridges 36. The ridges provide a gripping key between the brick-tie and the mortar. There is no need for ridges in the under-surface 32, which can be moulded flat.

The distance of separation of the inside surface 37 of the brick 34 from the stud 23 (or rather, from the waterproof paper 25) is a matter for the local building code; generally, the distance is twenty-five or thirty-five mm. The brick-tie 26 can be is dimensioned to suit. The designer of the brick-tie can provide a one-size-fits-all design, or can provide a number of sizes of brick-tie to suit the different codes.

The horizontal arm 40 of the brick-tie may be regarded as being in two portions: an in-mortar portion 29 and a bridge portion 47. The ridges 36 are provided in the in-mortar portion 29, whereas the bridge 47 can be plain.

The brick-tie 26 also includes a vertical arm 38. At the junction 39 between the vertical arm 38 and the horizontal arm 40, the brick-tie includes a buttress 42. A nail-hole 43 extends through the buttress, i.e extends right through to the back-face 45 of the vertical arm 38.

FIG. 1 also shows the use of a conventional metal-strip type of brick-tie 60. Such brick-ties are assembled to the studs also by nailing, but the metal strip is so thin that the strip can be bent by hand. The strip is flat when purchased, and is bent to the shape shown either before or after being nailed to the wall. Some builders use the brick-ties 60 as the means for holding the paper 25 in place, thereby avoiding the need to provide additional nails to hold the paper. In this case, all the brick-ties are nailed to the wall before bricklaying is even started. Some builders who do this are conscientious enough to mark off the heights where the brick-ties should be, in relation to the courses of bricks, but others do not bother, and just nail the brick-ties anywhere. Then, when the courses are laid, and the brick-ties come to be fitted between the courses, the horizontal arm of a particular brick-tie might be inches up or down from the nail. In this case, the contribution of the brick-ties to the stability of the wall is questionable.

It is pointed out that the conventional design of brick-tie does lend itself to this common type of mis-application. Even when the conventional brick-tie 60 is correctly fitted as to the vertical location of the nail (as in FIG. 1) it will be noted that the brick-tie is rather limited as to the amount of in/out restraint it provides, between the bricks and the studs. If a force arises tending to cause separation of the bricks away from the studs, (or to cause an approach of the bricks to the studs) the conventional ties are too flexible, when acted upon by such forces, with the result that in fact the conventional brick-ties provide only a minimum of effective tying power. They provide good restraint against the bricks moving a large distance away from the studs, but they provide very little restraint against the bricks moving through small distances.

It is recognised that brick-ties do have to have some give, but still, the restraint provided by a brick-tie should be better than that of the conventional design, and an aim of the present design to provide that improved restraint.

A brick-tie has to have some give in the up/down direction. Nailing the brick-tie to the wall, as described, can never be a highly accurate operation, as to the height of the brick-tie in relation to the course of bricks. Also, the bricks, the studs, and the plywood, are subject to settling, drying out, and to other distortions of various kinds, to the extent that a complete lack of flexibility in the brick-ties might cause problems.

Therefore, the bridge portion 47 of the horizontal arm 40 should be thin enough to accommodate a little flexure in the up/down sense.

On the other hand, it is an excess of this type of flexibility that renders the conventional metal-strip type of brick-tie 60 less than satisfactory. In a brick-tie, there is an angle between the portion that is nailed to the stud and the portion that lies between the courses of bricks; in the present design that angle is moulded into the structure, whereas in the conventional design that angle is provided by the bricklayer bending the brick-tie with his fingers. In the conventional design, it was this requirement—that the strip be bendable with the fingers in the angle region—that made the strip too flexible in the bridge region. In the present design, the bridge portion can be much stiffer, because the bricklayer does not have to bend the device with his fingers.

In the present design, the designer is not compromised by having to make the device so flexible that it can be bent with the fingers. Therefore, the designer can engineer the design to provide the most advantageous degree of flexibility in the up/down sense, without compromise.

In the present design, it has been found that a bridge having a thickness of about 5 mm provides the required degree of stiffness. The brick-tie is moulded in high-density polyethylene, HDPE, and is about 25 mm wide. It is important that the thickness be present at least in the stud-end 49 of the bridge 47, even if the bridge tapers (slightly) towards the brick end 48 of the bridge.

The buttress 42 provides some stiffness against flexure of the angled junction 39 between the vertical arm 38 and the horizontal arm 40. However, providing that stiffness is not the primary purpose of the buttress. Rather, the buttress 42 serves to ensure that the brick-tie is highly rigid in the area around the nail. The brick-tie's only securement to the stud 23 is via the nail 27, and it is the designer's aim to have as much as possible of region around the nail-hole 43 subjected to the influence of the nail. Thus, the more rigid the brick-tie in the area of the nail-hole, the more the securement provided by the nail is translated into effective restraint.

It may be noted that the nail is located near the angled-junction between the horizontal and vertical arms. The arms complement each other. The presence of the horizontal arm serves to stiffen the vertical arm, and prevent the vertical arm from curling or bowing, and correspondingly the presence of the vertical arm serves to stiffen the horizontal arm, and prevent the horizontal arm from curling or bowing. Again, it is noted that the stiffer the angled junction region 39 of the device, the more strongly the securement provided by the nail 27 is translated into restraint between the bricks and the studs, and the better the performance of the brick-tie in keeping constant the spacing between the bricks and the studs, under varying conditions (of weather, etc).

It is also noted, for the same reasons, that the stud-end 49 of the bridge 47 should be thick all the way across, i.e that the margins 50 of the stud-end 49 should be thick, as well as the centre of the stud-end. These marginal portions 50, being thick, serve to stabilise the shape of the device at the junction, and to keep that region stiff.

The above remarks relating to the stud end 49 of the bridge 47 also relate to the bottom portion 52 of the vertical arm 38, i.e the portion surrounding and below the nail-hole 43.

The junction or angle area 39 of the brick-tie 26 being stiff, as described, the whole junction area remains as one.

It is as if many nails had been used to secure the whole area to make it unitary with the stud.

The designer might indeed provide for two nails, or more. However, further nails are not preferred, because it would be more difficult then to line up both (or all) nails with the stud. This is especially the case when the bricklayer is a little too casual. Also, it would be difficult for the building inspector to tell whether both nails were properly entered into the stud. Inevitably, a significant number of brick-ties would only be attached to the stud by one nail, at one side. In the preferred arrangement, when only one nail secures the brick-tie to the stud, the bricklayer would almost have to be deliberately over-casual not to nail the brick-tie properly to the stud.

It may be noted that extra nails above or below the junction area would be of little use, since they would not tend to make the bridge-portion effectively unitary with the stud.

As mentioned, some bricklayers prefer to put the brick-ties on the wall before starting to lay the bricks, because then the nails used to secure the brick-ties can be used to secure the waterproof paper 25 to the studs also. One reason for this practice, apart from saving nails, is that builders prefer to puncture the paper in as few places as possible. The moulded brick-tie 26 as described herein can be applied in this way, but because the brick-tie 26 cannot be bent to shape, the position in which to nail the brick-tie must be pre-measured, fairly accurately, as to where the courses of bricks will lie. Of course, with care, this can be done.

The back-face 45 of the vertical-arm 38 of the moulded brick-tie 26 is large in area. The large area combines good securement for the paper 25, with little chance of tearing the paper.

The brick-tie 26 as described herein, being of moulded plastic, can be provided with a nail-hole 43 that is slightly smaller than the nail 27. During manufacture, nails can be inserted partway into the nail-holes in-factory, and the unit sold with the nails in place. In this regard, it may be noted that such pre-assembled nail lies within the overall outline of the device; brick-ties are generally purchased and used not individually but by the box-full, and it is important that, in the box, the nail does not protrude an awkward distance, nor at an awkward angle, with respect to the brick-tie itself Also because the product is of moulded plastic, the nail-hole has length, and so can be used to position the nail at the correct angle. This may be contrasted with the conventional design, where the nail is not guided at all by the brick-tie, and can be at any angle.

Figure 6:
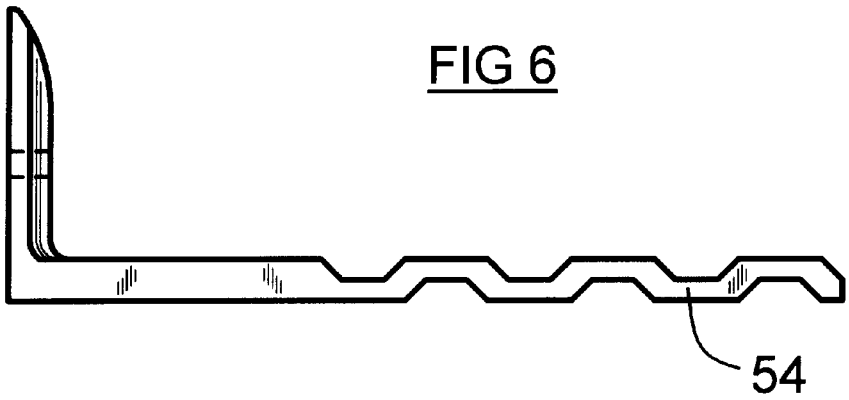
FIG. 6 is a side view of another brick-tie.
Figure 7:
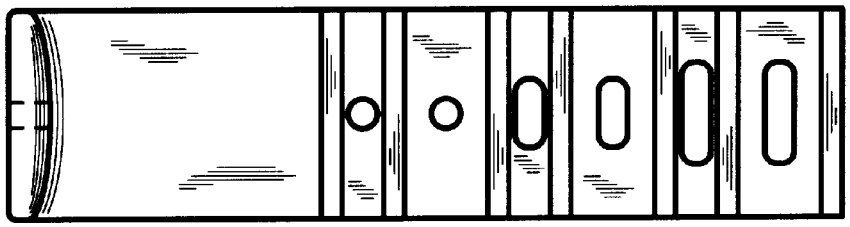
FIG. 7 is a plan view of the brick-tie of FIG. 6.

FIGS. 6 and 7 show another version of the plastic moulded brick-tie. Here, the manner of keying the horizontal arm into the mortar is more secure, because of the profile or shape of the in-mortar portion 54 of the arm, and the holes therethrough. As shown, although ridges are not needed underneath the horizontal arm, of course they can be provided.

Figure 8:
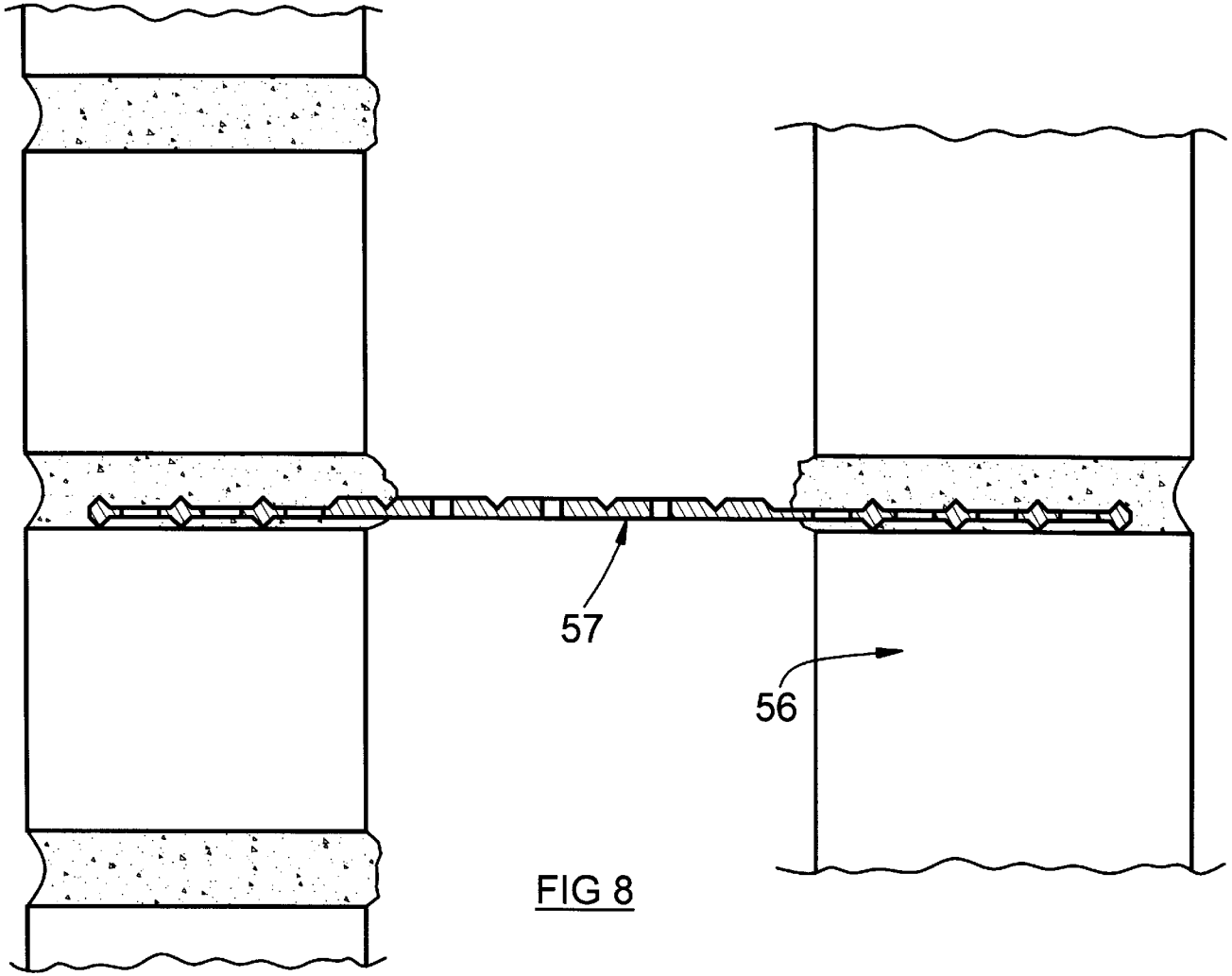
FIG. 8 is a side view of another brick-tie.

FIG. 8 shows another version of the plastic moulded brick tie. Here, the fixed structure is not a stud wall (as in FIG. 1), but another brick wall 56. Again, the benefits of a thick and chunky bridge portion 57 are combined with the benefits of using plastic.

What is claimed is:

1. A brick-tie, for tying courses of bricks in a brick wall to a fixed structure, the fixed structure being physically separate from, and spaced from, the courses of bricks, wherein:

the brick-tie is a one-piece moulding, in plastic;

the brick-tie includes a horizontal arm, which includes an in-mortar portion and a bridge portion;

the in-mortar portion is of such structure as to be suitable for placement, in mortar, between courses of bricks in a brick wall;

the in-mortar portion is provided with moulded-in surface configurations, for increasing the securement grip thereof into the mortar;

one end of the bridge-portion is contiguous with the in-mortar portion;

the brick-tie includes a means for securing the other end of the bridge-portion to the fixed structure;

the bridge-portion of the brick-tie is dimensioned to be so inflexible that the bridge-portion substantially cannot be bent by finger-manipulation.

2. Brick-tie of claim 1, wherein the bridge-portion of the horizontal arm is about 25 mm wide, by 5 mm thick.

3. Brick-tie of claim 2, wherein the material of the brick-tie is HDPE.

4. Brick-tie of claim 1, wherein the moulded-in surface configuration comprises a series of ridges.

5. Brick-tie of claim 1, wherein:

the brick-tie includes a vertical arm, and an angled junction between the vertical arm and the horizontal arm;

the means for securing the other end of the bridge-portion to the fixed structure comprises a nail-hole, through the vertical arm.

6. Brick-tie of claim 1, wherein the bridge-portion of the horizontal arm is thick and chunky.

7. The combination of a brick wall and a set of brick-ties, wherein:

each brick-tie in the set is a brick-tie as defined in claim 1;

the brick wall comprises several courses of bricks, having mortar between the courses;

the in-mortar portions of the horizontal arms of the brick-ties in the set lie embedded in the mortar between the courses of bricks.

8. Combination of claim 7, wherein:

the fixed structure is a stud wall;

in respect of each brick-tie in the set, the brick-tie includes a means for securing the other end of the bridge-portion to the stud wall, which includes a vertical arm and an angled junction between the vertical arm and the horizontal arm, and includes a nail-hole through the vertical arm;

and the combination includes nails, by which the brick-ties in the set are nailed to the studs of the stud wall.

9. A brick-tie, for tying courses of bricks in a brick wall to a fixed structure, the fixed structure being physically separate from, and spaced from, the courses of bricks, wherein:

the brick-tie is a one-piece moulding, in plastic;

the brick-tie includes a horizontal arm, which includes an in-mortar portion and a bridge portion;

the in-mortar portion is of such structure as to be suitable for placement, in mortar, between courses of bricks in a brick wall;

the in-mortar portion is provided with moulded-in surface configurations, for increasing the securement grip thereof into the mortar;

one end of the bridge-portion is contiguous with the in-mortar portion;

the bridge-portion of the brick-tie is dimensioned to be so inflexible that the bridge-portion substantially cannot be bent by finger-manipulation;

the brick-tie includes a means for securing the other end of the bridge-portion to the fixed structure, which includes a vertical arm and an angled junction between the vertical arm and the horizontal arm, and includes a nail-hole through the vertical arm.

10. Brick-tie of claim 9, wherein the nail-hole in the vertical arm is close to the angled junction.

11. Brick-tie of claim 9, wherein the portion of the vertical arm that lies between the nail-hole and the angled junction is thick and chunky.

12. Brick-tie of claim 9, wherein the nail-hole is located on the vertical centre of the vertical arm.

13. Brick-tie of claim 9, in combination with a nail, wherein:

the nail is pre-assembled into the nail-hole;

the nail-hole is smaller than the nail, whereby the nail is held gripped by the nail-hole.

* * * * *